US007349648B2

(12) United States Patent
Rennick et al.

(10) Patent No.: US 7,349,648 B2
(45) Date of Patent: Mar. 25, 2008

(54) SECURING MECHANISM FOR AN IMAGE FORMING DEVICE MODULE

(75) Inventors: David Erwin Rennick, Georgetown, KY (US); Jason Lee Rowe, Richmond, KY (US); Jeffrey Lawrence Tonges, Versailles, KY (US); Brian Allen Blair, Richmond, KY (US); Larry Steven Foster, Lexington, KY (US); Robert Galon Newman, Lexington, KY (US); Edward Lynn Triplett, Lexington, KY (US); Gary Michael Tylicki, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 322 days.

(21) Appl. No.: 11/231,859

(22) Filed: Sep. 21, 2005

(65) Prior Publication Data

US 2007/0065174 A1 Mar. 22, 2007

(51) Int. Cl.
*G03G 15/00* (2006.01)

(52) U.S. Cl. ..... 399/110

(58) Field of Classification Search ..... 399/124, 399/110

See application file for complete search history.

(56) References Cited

U.S. PATENT DOCUMENTS

| | | | | |
|---|---|---|---|---|
| 4,634,264 | A | 1/1987 | Takahashi | |
| 4,642,661 | A | 2/1987 | Dean, II | |
| 4,668,076 | A | 5/1987 | Iseki et al. | |
| 4,896,193 | A | 1/1990 | Kagiura et al. | |
| 5,041,872 | A | 8/1991 | Nukaya et al. | |
| 5,086,316 | A | 2/1992 | Aoki | |
| 5,220,387 | A | 6/1993 | Tsunoda et al. | |
| 5,253,028 | A | 10/1993 | Gonda et al. | |
| 5,255,061 | A | 10/1993 | Matsuura et al. | |
| 5,285,240 | A * | 2/1994 | Kinoshita et al. | 399/110 |
| 5,300,998 | A * | 4/1994 | Ogisawa et al. | 399/124 |
| 5,787,324 | A | 7/1998 | Iwasaki | |
| 5,897,244 | A | 4/1999 | Miyazaki et al. | |
| 5,930,564 | A | 7/1999 | Ookaji | |
| 6,125,251 | A | 9/2000 | Shiraishi et al. | |
| 6,134,404 | A | 10/2000 | Iwai et al. | |
| 6,215,970 | B1 | 4/2001 | Yoshikawa et al. | |
| 6,477,346 | B1 | 11/2002 | Yahagi | |
| 7,162,182 | B2 * | 1/2007 | Tonges et al. | 399/110 |
| 2006/0039718 | A1 * | 2/2006 | Yokoi | 399/124 |
| 2006/0291897 | A1 * | 12/2006 | Ozawa | 399/110 |
| 2006/0291901 | A1 * | 12/2006 | Hiroe et al. | 399/124 |
| 2007/0048004 | A1 * | 3/2007 | Murrell | 399/110 |

FOREIGN PATENT DOCUMENTS

JP 2001152724 A * 6/2001

* cited by examiner

*Primary Examiner*—Susan Lee
(74) *Attorney, Agent, or Firm*—Coats & Bennett PLLC

(57) ABSTRACT

An image forming device with one or more door assemblies that engage locking mechanisms to secure a module in an operating position. The module may be coupled to one of the one or more door assemblies. A first locking mechanism may secure the module to the image forming device body when a first door assembly is closed. A second locking mechanism may secure the module to the body with a greater securing force than the first locking mechanism to secure the module to the body. The second locking mechanism may be engaged upon closing a second door assembly. Separate biasing members may be used to apply the securing forces. The locking mechanisms may include four-bar or over-center mechanisms to apply the securing forces.

21 Claims, 16 Drawing Sheets

SECURING MECHANISM FOR AN IMAGE FORMING DEVICE MODULE

BACKGROUND

Image forming devices often have modular designs comprising a plurality of consumer replaceable units (CURS). Some example CURS include waste toner cartridges, developer cartridges, photoconductive members, and transport belt modules. Some of these CURS are consumable items that are used or worn with use. Over the life of an image forming unit, these CURS may be replaced multiple times. Replacing the CRUs typically requires access to the interior of the image forming unit.

Replacement and mounting of these modules is vital to acceptable user ergonomics. The modules should be positioned in a manner to be accessible to the user. The complex design of many current devices makes accessing the components difficult. The modules may be located within the interior of the device making it very difficult to grasp and manipulate the modules. Intricate cartridge mounting locations may also result in toner spills and component damage, which may result in print defects, or the device not operating properly.

In addition to replacing CRUs, there may be other times when it is necessary to access the interior of an image forming device. For instance, paper jam errors sometimes require access to interior portions of a paper feed path to clear misfeeds. To that end, image forming devices are often provided with exterior door panels. These door panels often comprise some portion of the exterior housing of the image forming device and may be opened and closed as needed to access the interior of the device.

As image forming devices become smaller in size, rigid space constraints may limit placement options for internal components, including CRUs. In some cases, it may be desirable or even necessary to mount CRUs and other modules to a door panel such that the module moves with the door panel as it opens. For example, a paper transport belt module may be coupled, directly or indirectly, to a door assembly. With this configuration, the belt module moves with the door panel to an open position improving the ease with which users may clear paper jams.

Furthermore, knowledge of the rates at which CRUs are replaced may also drive component placement. In certain instances, one or more modules that are used to transfer toner images within the image forming device may be coupled to a door panel. Thus, when the door panel opens, these door-mounted modules may move to expose other CRUs. This type of configuration may improve the ease with which frequently replaced modules are removed and installed. As the door panels are closed, these modules are repositioned to operate in the image formation process.

Aside from each of these considerations, it is also important that the components be mounted within the device to produce images of acceptable print quality. This requires that the components are located accurately within the device during image formation. Inaccurate locating of the cartridges may result in image forming defects, toner leakage, and other detrimental effects. Therefore, modules should be mounted using secure mounting configurations, which often necessitates large hold-in forces. Unfortunately, ergonomic constraints also dictate that modules should be installed and door panels should be closed with minimal user input force.

SUMMARY

Embodiments of the present invention are directed to devices and methods for securing image forming device modules within an image forming device. In one embodiment, the module may be coupled to one of a plurality of moveable door assemblies. A first locking mechanism may secure the module to the image forming device body when a first door assembly is positioned in a closed orientation. Similarly, a second locking mechanism may secure the module to the body with a greater securing force than the first locking mechanism. In one embodiment, the second locking mechanism may be engaged when a second door assembly is positioned in a closed orientation. The locking mechanisms may comprise a common clamping member that is engaged using separate over-center mechanisms. These separate over-center mechanisms may each have its own biasing member to secure the module to the body. The second locking mechanism may be engaged through movement of a lever arm to rotate an over-center crank that moves a reciprocating link into and out of engagement with the biasing member. The lever arm may be pivotally attached to the second door assembly so that it rotates the over-center crank when the second door assembly moves between an open and closed orientation.

In one embodiment, a shared clamping member may be engaged using a four-bar locking mechanism to secure the module to the body with a first securing force when the first door assembly is closed. The four-bar locking mechanism may also apply a second securing force that is greater than the first securing force when the second door assembly is closed.

DETAILED DESCRIPTION

Figure 1A:
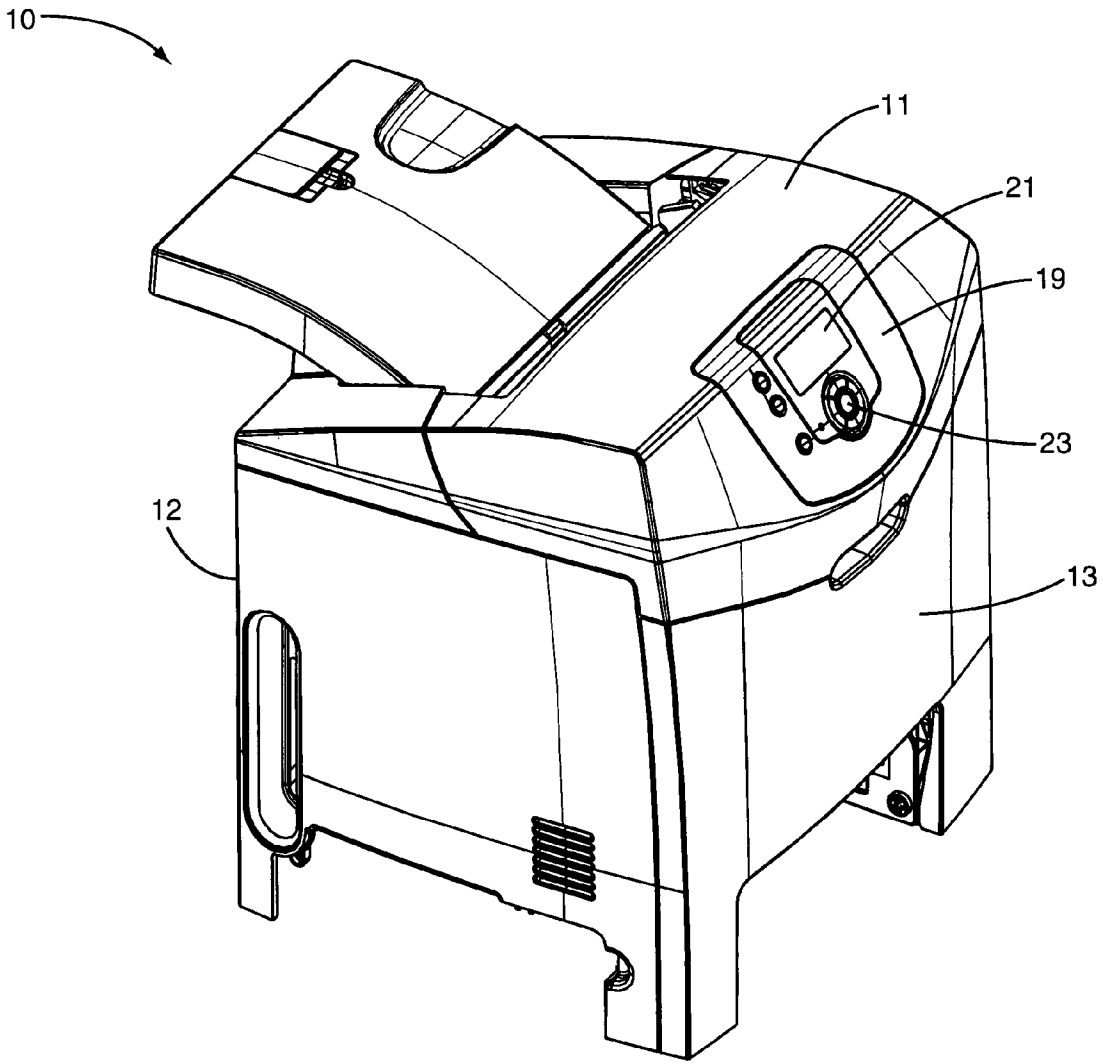
FIGS. 1A-1C are schematic diagrams of an image forming device having a plurality of moveable door assemblies according to one embodiment of the present invention.

The various embodiments disclosed herein are directed to securing and stabilizing image forming device modules in an operating position. These modules may be accurately held with large hold-in forces applied using a mechanical advantage. Thus, the user effort required to apply these large hold-in forces may be minimal. The various embodiments may be implemented in an image forming device of the type indicated generally by the numeral 10 in FIGS. 1A-1C. The exemplary image forming device 10 comprises a main body 12 and two door assemblies 11, 13. As used herein, the term "door assembly" is intended to refer to a door panel that is movably or detachably coupled to the main body 12. Exemplary door assemblies 11, 13 may simply comprise a door panel and any mounting hardware that permits relative movement between the main body 12, including but not limited to hinges and link arms or pivot arms. As indicated below, other components may be coupled to the door assemblies 11, 13. The first door assembly 11 is located towards a top side of the image forming device while the second door assembly 13 is located towards a lateral side of the image forming device. In the exemplary image forming device 10, a user interface panel 19 comprising a display 21 and one or more input buttons 23 is disposed on the first door assembly 11.

Figure 1B:
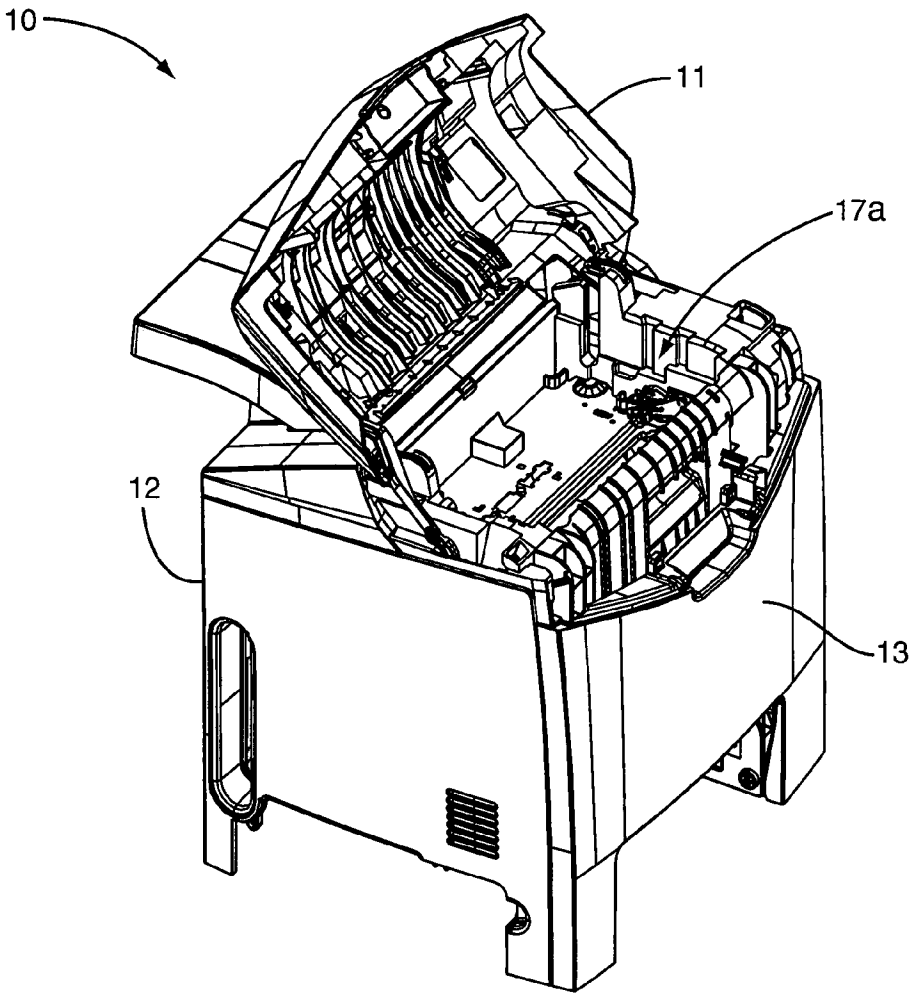
Figure 1C:
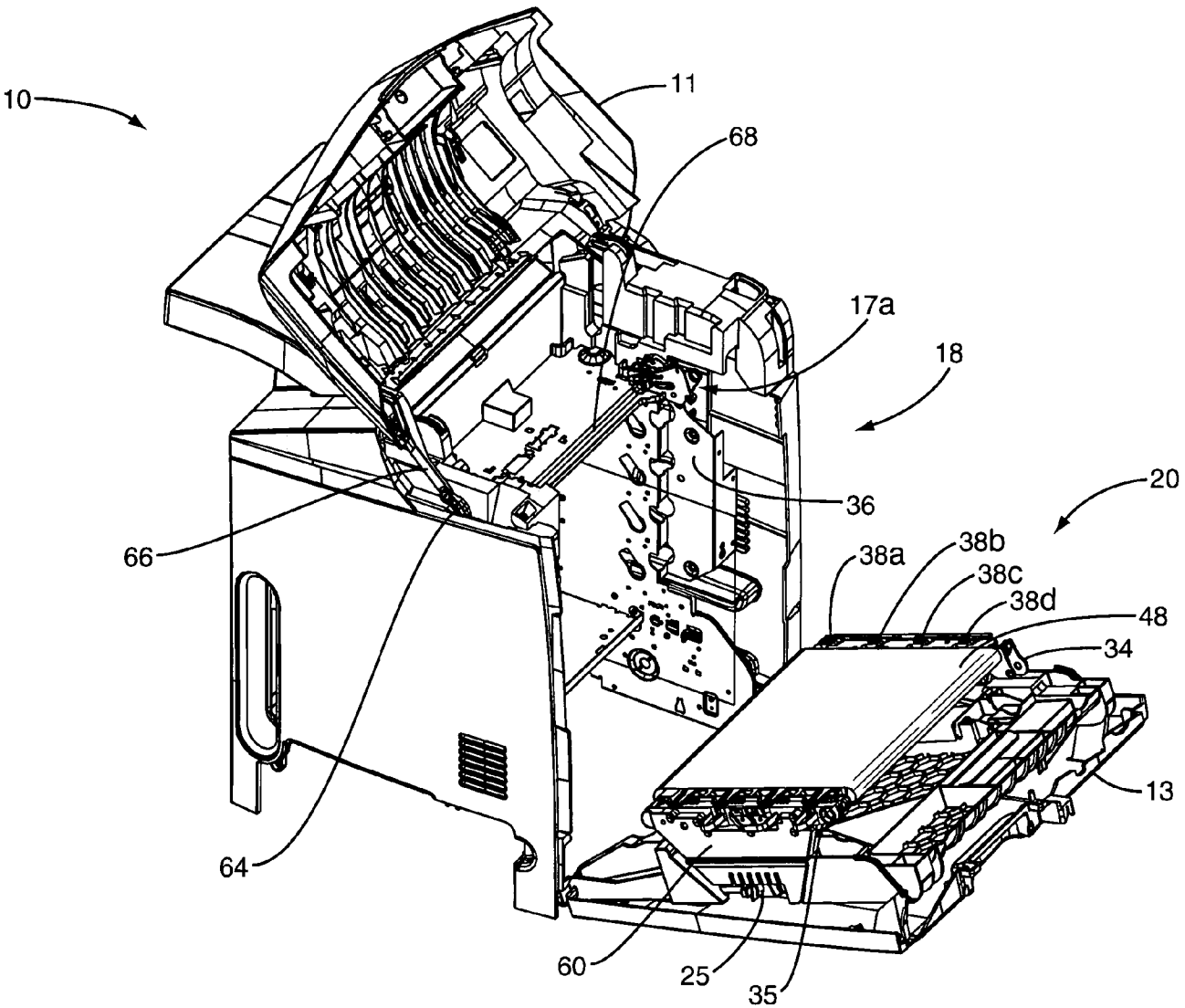

Each door assembly 11, 13 is movable between a closed position as shown in FIG. 1A and an open position as shown in FIGS. 1B and 1C. In the exemplary embodiment, the door assemblies are opened in the order illustrated by the progression from FIG. 1A to FIG. 1B to FIG. 1C. That is, access to the interior of the image forming device 10 may be provided by first opening the first door assembly 11 followed by the second door assembly 13. The door assemblies 11, 13 are returned to the operating position in the reverse order. That is, the second door assembly 13 is closed before the first door assembly 11.

One or more modules may be coupled to the first and second door assemblies 11, 13. For instance, FIG. 1C shows a belt module 20 coupled to the second door assembly 13. The belt module 20 may be an image transfer belt, a document transport belt, or other belt commonly used in image forming devices 10. The schematic illustration provided in FIG. 2 shows one embodiment of an image forming device 10 where belt module 20 is implemented as a transport belt module.

Figure 2:
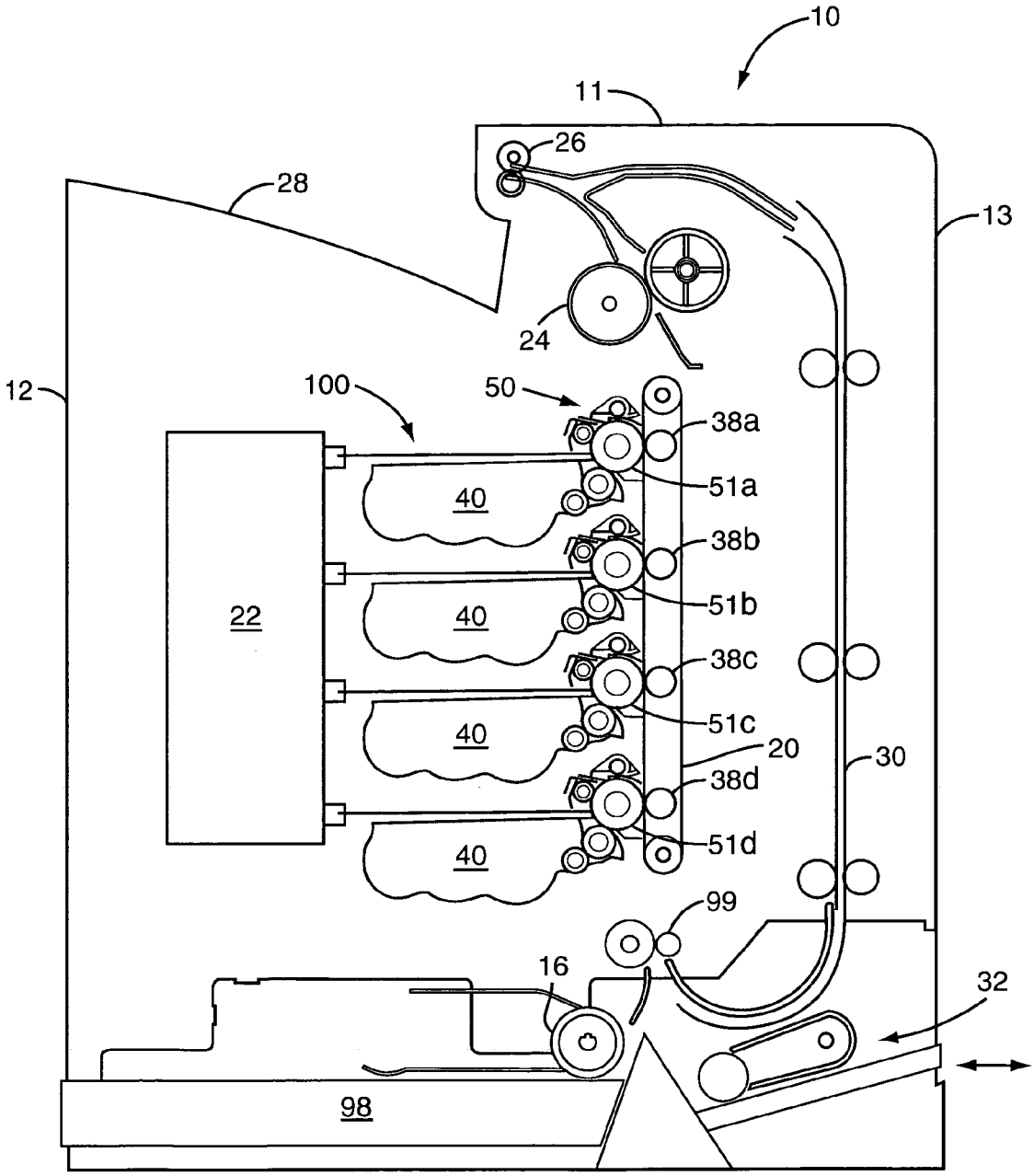
FIG. 2 is a functional block diagram of an image forming apparatus according to one embodiment of the present invention.

The exemplary image forming device shown in FIG. 2 includes a media tray 98 with a pick mechanism 16 and a multi-purpose feeder 32, both of which are conduits for introducing media sheets into the device 10. The media tray 98 is preferably removable for refilling, and located on a lower section of the device 10. Media sheets are moved from the input and fed into a primary media path. One or more registration rollers 99 disposed along the media path aligns the print media and precisely controls its further movement along the media path. The belt module 20 forms a section of the media path for moving the media sheets past a plurality of image forming units 100. Color printers typically include four image forming units 100 for printing with cyan, magenta, yellow, and black toner to produce a four-color image on the media sheet.

An optical scanning device 22 forms an electrical charge on photoconductive members 51*a-d* within the image forming units 100. The media sheet with loose toner is then moved through a fuser 24 that adheres the toner to the media sheet. Exit rollers 26 rotate in a forward direction to move the media sheet to an output tray 28, or rollers 26 rotate in a reverse direction to move the media sheet to a duplex path 30. The duplex path 30 directs the inverted media sheet back through the image formation process for forming an image on a second side of the media sheet.

Figure 3:
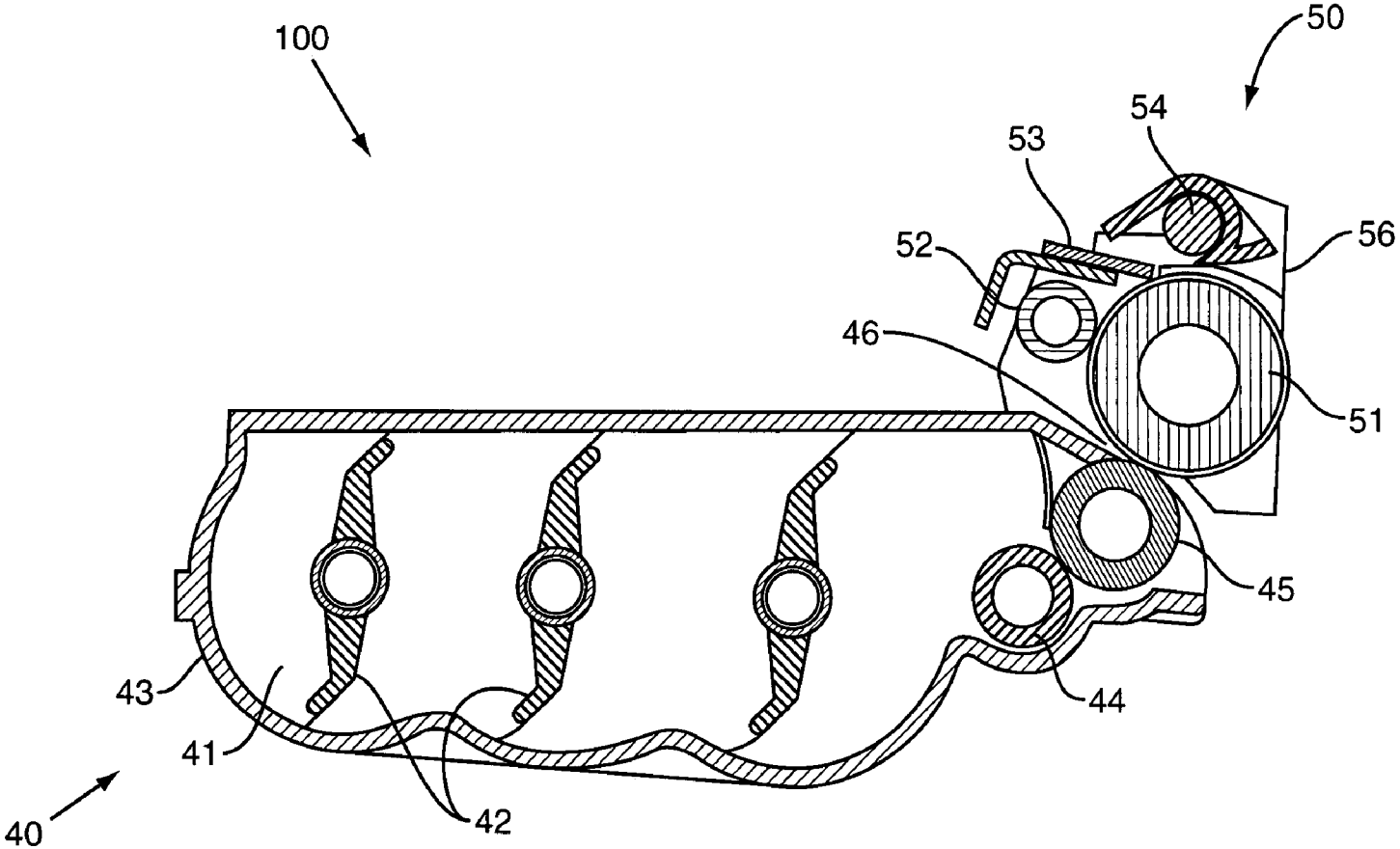
FIG. 3 is a cross-sectional view of an image forming unit according to one embodiment of the present invention.

Referring to FIG. 3, the schematic illustration shows a cross-sectional view of the image forming unit 100. The developer unit 40 comprises an exterior housing 43 that forms a reservoir 41 for holding a supply of toner. One or more agitating members 42 are positioned within the reservoir 41 for agitating and moving the toner towards a toner adder roll 44 and the developer member 45. Toner moves from the reservoir 41 via the one or more agitating members 42, to the toner adder roll 44, and finally is distributed to the developer member 45. The developer unit 40 is structured with the developer member 45 on an exterior section where it is accessible for contact with the photoconductive member 51.

The photoconductor unit 50 comprises a photoconductive member 51, and a charger 52. In one embodiment, the photoconductive member 51 is an aluminum hollow-core drum coated with one or more layers of light-sensitive organic photoconductive materials. Charger 52 applies an electrical charge to the photoconductive member 51 to receive an electrostatic latent image from the imaging device 22 (FIG. 2). A cleaner blade 53 contacts the surface of the photoconductive member 51 to remove toner that remains on the photoconductive member 51. The residual toner is moved to a waste toner auger 54 and moved out of the photoconductor unit 50. A housing 56 forms the exterior of a portion of the photoconductor unit 50. The photoconductive member 51 is mounted protruding from the photoconductor unit 50 to contact the developer member 45.

Figure 4:
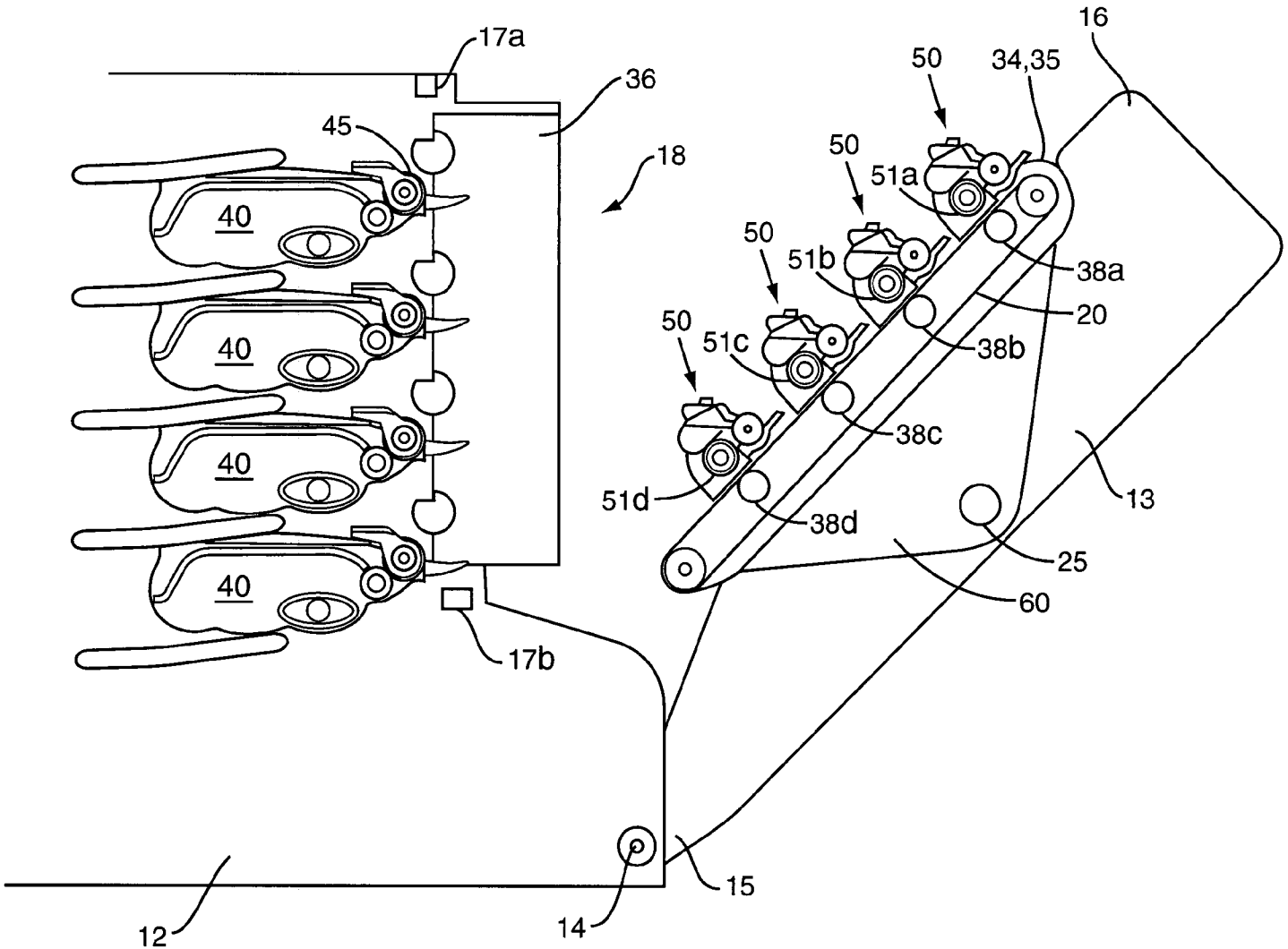
FIG. 4 is a is a cut-away side view of a door in an open orientation according to one embodiment of the present invention.

As indicated above, at least one internal module is attached to the second door assembly 13 and moves with the second door assembly 13 as it moves between an open and closed position. FIG. 1C shows at least a belt module 20 being coupled to the second door assembly 13. Other modules may be coupled to the second door assembly as well. For example, some portion or the entire image forming unit 100 may be coupled to the second door assembly 13. FIGS. 2 and 3 show exemplary image forming units 100 that are constructed of a separate developer unit 40 and a photoconductor unit 50. The developer unit 40, including a developer member 45, may be positioned within the main body 12 whereas the photoconductor unit 50 may be mounted to the second door assembly 13 along with the aforementioned belt module 20. In a closed orientation as illustrated in FIGS. 1A, 2, and 3, the second door assembly 13 is positioned adjacent to the main body 12 with the photoconductive member 51 of the photoconductor unit 50 positioned adjacent the developer member 45 of the developer unit 40. In an open orientation as illustrated in FIG. 4, the second door assembly 13 is moved away from the main body 12 separating the photoconductor unit 50 and belt module 20 from the developer unit 40. This configuration provides direct and easy user access to the developer unit 40, photoconductor unit 50, and the belt module 20. It has been determined that the highest user intervention rates are at the developer unit 40, photoconductor unit 50, and media path in the vicinity of the belt module 20.

In this two-piece cartridge architecture, the developer unit 40 and photoconductor unit 50 are mounted to ensure good contact axially along a developer nip 46 across a print zone between the developer member 45 in the developer unit 40 and the photoconductive member 51 in the photoconductor unit 50. The accurate placement of each developer unit 40 and photoconductor unit 50 is important for uniform contact pressure along the full axial extent of the developer nip 46.

As illustrated in FIGS. 1C and 4, the main body 12 has enclosed sides forming an opening 18 for mounting the developer units 40. Developer units 40 are positioned within the opening 18 with the developer roll 45 extending outward to contact the photoconductive member 51 during image formation. Opening 18 may be sized to encompass the entire side of the main body 12, or may comprise only a limited portion of one side. In the embodiment of FIG. 4, opening 18 is positioned on a lateral side of the main body 12. Opening 18 may also be positioned on the top or bottom side of the main body 12 depending upon the application. For instance, in image forming devices 10 that orient the image forming units 100 in a more horizontal configuration, the opening 18 may be advantageously placed towards a top side of the main body 12.

Second door assembly 13 is movably attached relative to the main body 12 between an opened orientation as illustrated in FIGS. 1C and 4 and a closed orientation as illustrated in FIGS. 1A and 2. The second door assembly 13 may be attached to the main body 12 in a variety of manners. FIG. 4 illustrates one embodiment with the second door assembly 13 pivotally attached to the main body 12 through a pivot 14. Pivot 14 may attach the main body 12 and second door assembly 13 at a variety of locations, such as towards a lower edge 15. In the open orientation, the door assembly upper edge 16 is spaced from the main body 12. This orientation provides access to the developer units 40, photoconductor units 50, and media path, including belt module 20. In the closed orientation, the upper edge 16 is in proximity to the main body 12. The upper edge 16 may be in contact with the main body 12, or slightly spaced apart from the main body 12.

Referring to FIGS. 1C and 4, the belt module 20 is coupled, at least loosely, to second door assembly 13. FIG. 4 further shows the photoconductor units 50 coupled to the door assembly 13. The photoconductor units 50 are omitted from FIG. 1C for clarity. Opposing roller frames 34, 35 are disposed in a spaced apart configuration so that rollers 38*a*-38*d* span the distance between roller frame 34 and roller frame 35. The roller frames 34, 35 may be wholly separate members or may form part of a single member that is coupled to the door assembly 13. An endless belt 48 extends around the rollers 38*a*-38*d*. In one embodiment, the rollers 38*a*-38*d* are transfer rollers that are electrically biased to promote the transfer of a developed image from an associated photoconductive member 51 to a media sheet. Alternatively, the endless belt 48 may be an image transfer belt and the developed image may be transferred to the endless belt 48 for subsequent transfer to a media sheet.

The roller frames 34, 35 are attached to a subframe 60 that is pivotally attached to the second door assembly 13 at a second pivot 25. The second pivot 25 allows the subframe 60 to move relative to the second door assembly 13 when the second door assembly 13 is in the open orientation. In the closed orientation, the roller frames 34, 35 and subframe 60 are accurately aligned with the main body 12 such that the photoconductive members 51 are aligned with the developer rolls 45. One or more locks 17 maintain the second door assembly 13 in the closed orientation and secure the roller frames 34, 35 and subframe 60 in this aligned position when the second door assembly 13 is in the closed orientation. In one embodiment, a total of four locks 17 connect the roller frames 34, 35 and subframe 60 to the main body 12 with two locks each on an upper (17*a*) and lower (17*b*) portion of the opening 18.

Figure 5:
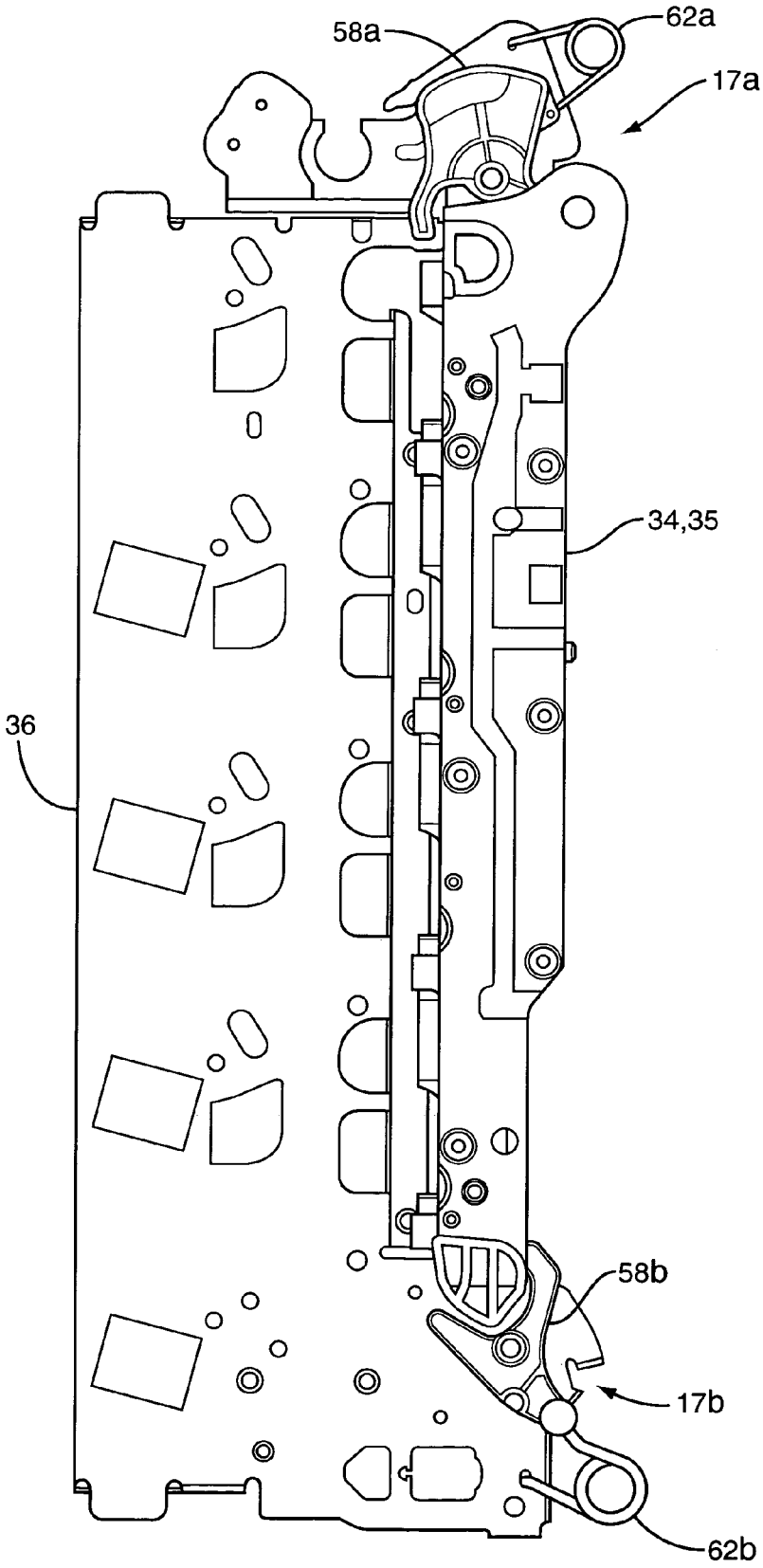
FIG. 5 is a partial side view of locking members used to secure an image forming device module according to one embodiment of the present invention.

FIG. 5 illustrates a more detailed representation of the aforementioned locks 17. Specifically, FIG. 5 shows an upper lock 17*a* and a lower lock 17*b* used to secure roller frame 34 to an interior frame 36. The interior frame 36 is disposed within the interior of the image forming device housing 12. The remaining portions of the image forming device 10, including image forming units 100, and second door assembly 13 are omitted from FIG. 5 for clarity. The roller frame 34 is depicted in the closed orientation in FIG. 5. The upper lock 17*a* and lower lock 17*b* are depicted in a locked orientation, thereby securing the roller frame 34 in this closed orientation.

In one embodiment, the upper locks 17*a* and lower locks 17*b* comprise over-center clamps 58*a* and 58*b*, respectively, that are pushed over center by motion of the roller frame 34, 35 when the second door assembly 13 is opened and closed. The upper lock 17*a* includes a first biasing member 62*a* that provides some nominal first securing force when the roller frame 34, 35 is moved from the open orientation to the closed orientation as shown in FIG. 5. Lower lock 17*b* also includes a corresponding biasing member 62*b* that performs a similar function. Biasing members 62*a* and 62*b* are selected to limit the amount of user force that is required to move the second door assembly 13 and roller frame 34, 35 into the closed position. As a consequence, the biasing members 62*a* and 62*b* may not be sufficient to accurately and securely hold the roller frame 34, 35 (and hence the belt module 20 and photoconductive unit 50) in the closed orientation for quality image production.

Figure 6A:
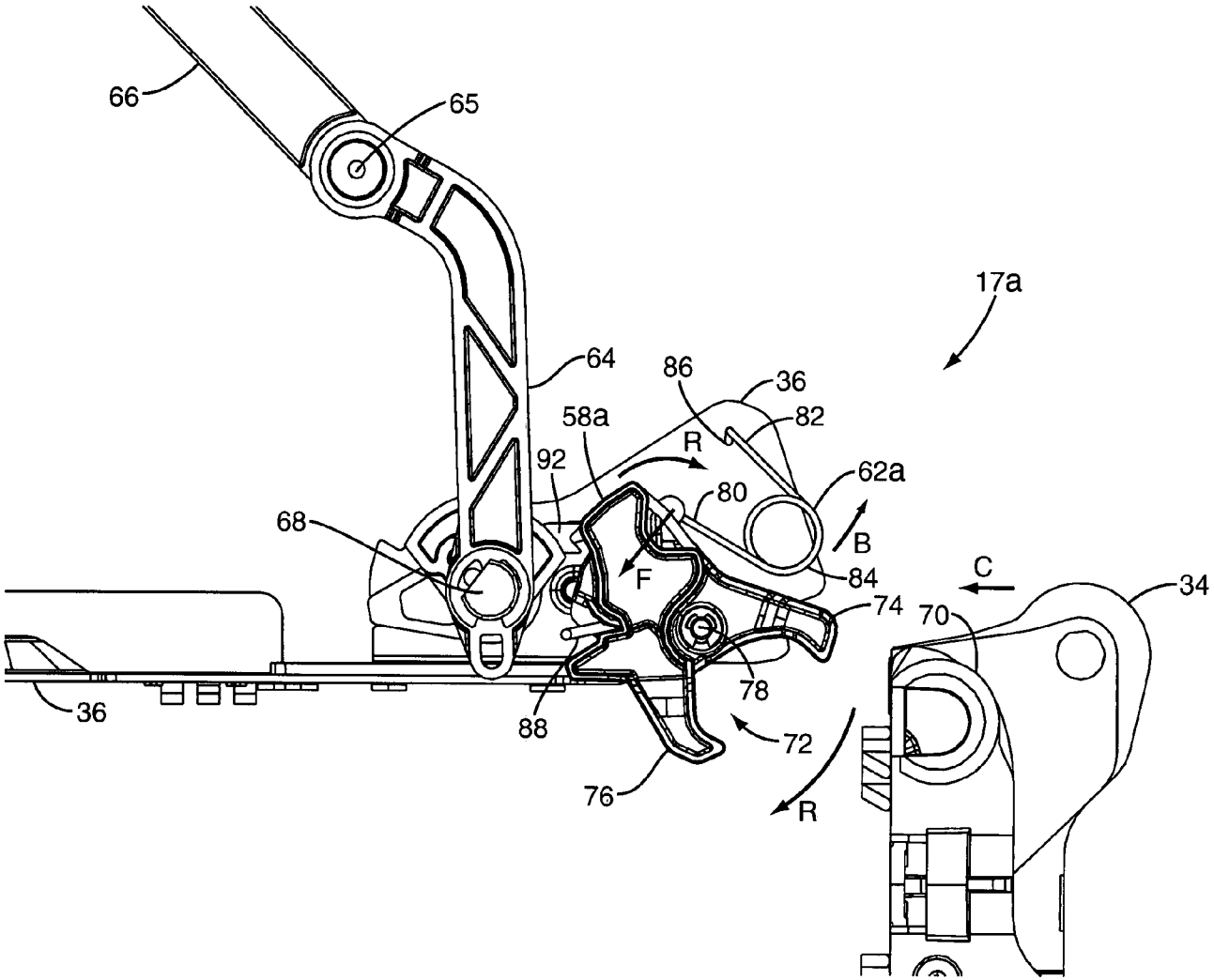
FIGS. 6A-6C are schematic diagrams showing a sequence by which a locking member secures an image forming device module according to one embodiment of the present invention.
Figure 6B:
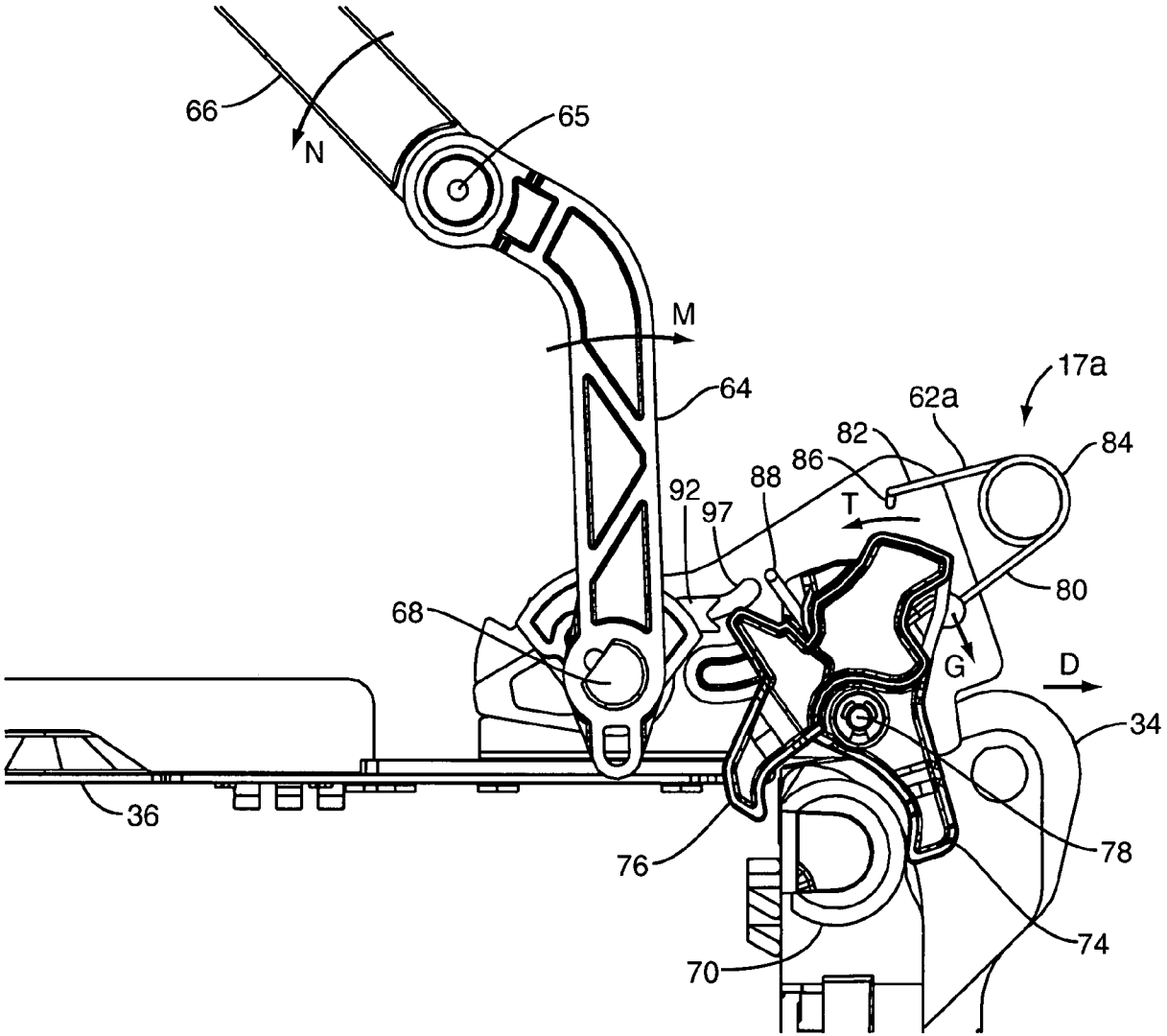
Figure 6C:
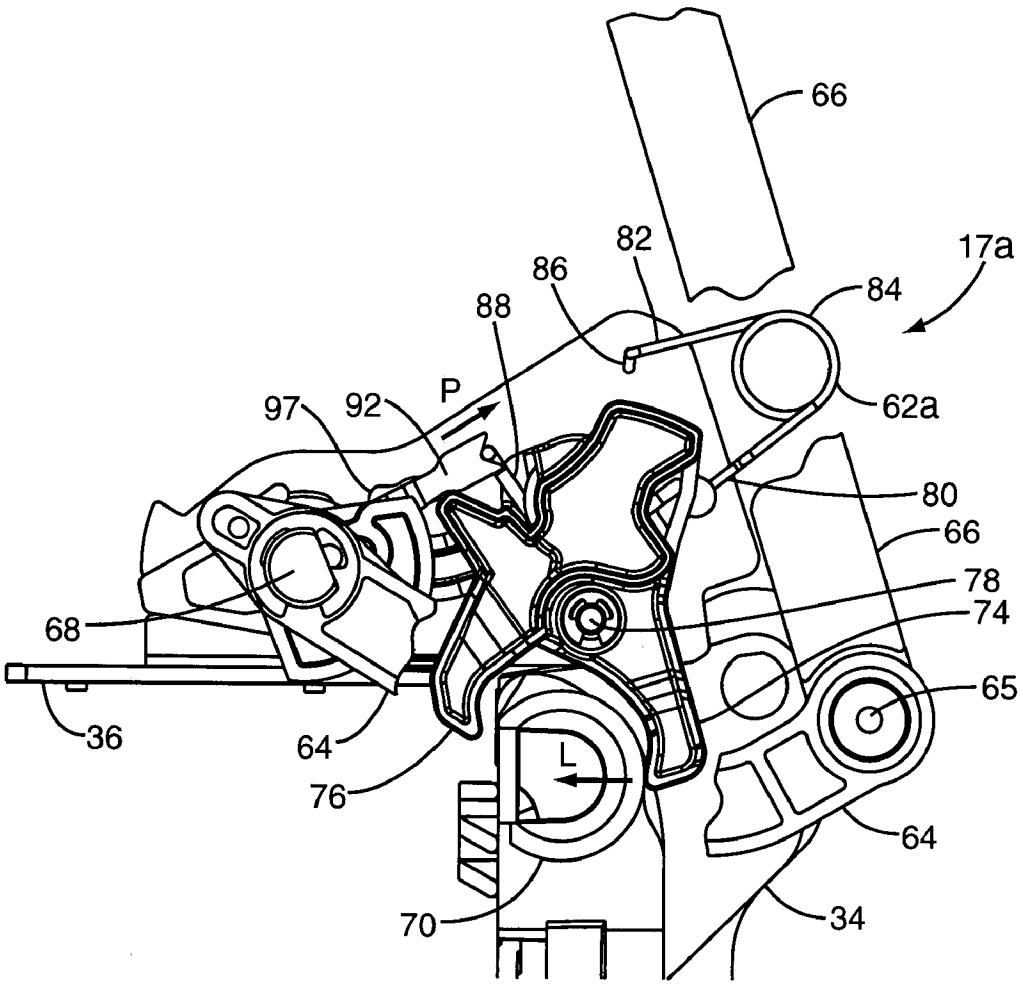

Therefore, additional securing force may be provided by the locks 17*a*, 17*b* by actuating a locking sequence as shown in FIGS. 6A-6C and 7A-7C. Note that the illustration provided in FIG. 6C shows cutaway portions of a first pivot arm 64 and a second pivot arm 66 to reveal the other components of the upper lock 17*a*. FIGS. 6A-6C illustrate relevant parts of the image forming device 10 involved in securing the roller frame 34, 35, including an upper lock 17*a* coupled to interior frame 36. FIG. 8 shows a perspective view of some of the same components, including the upper lock 17*a* with the first door assembly 11 in the closed orientation and the roller frame 34 secured in the operating position. The lower lock 17*b* operates in a manner similar to upper lock 17*a* and a detailed description thereof is not provided herein. FIGS. 6A-6C and 8 also show a first pivot arm 64 and a second pivot arm 66 that are coupled to the first door assembly 11. The first pivot arm 64 and second pivot arm 66 are also visible (on the near side) in FIG. 1C. FIGS. 1C, 6A-6C, and 8 also show a crank shaft 68 that rotates in conjunction with the motion of first pivot arm 64 and second pivot arm 66. A more detailed description of the movement of pivot arms 64, 66 and crank shaft 68 is provided below.

The progression from FIG. 6A to FIG. 6B to FIG. 6C shows a locking sequence that provides an adequate securing force to hold the roller frame 34 in the closed position while minimizing the amount of user input force needed to initiate the illustrated motions. Initially, as shown in FIG. 6A, the roller frame 34 is in an open orientation and is spaced away from the upper lock 17*a*. As the second door assembly 13 and roller frame 34 are pushed into a closed orientation (in the direction indicated by arrow C in FIG. 6A), a protrusion 70 on the roller frame 34 engages a gap 72 between a first clamp arm 74 and a second clamp arm 76. The contact between the protrusion 70 and the second clamp arm 76 causes the clamp 58*a* to rotate about a clamp pivot 78 in the direction indicated by the arrow labeled R.

In the embodiment shown, the first biasing member 62*a* is implemented as a torsion spring having a coiled portion 84 and first 80 and second 82 legs. The first leg 80 of first biasing member 62*a* is coupled to the clamp 58*a* and the second leg 82 is coupled to an aperture 86 in the interior frame 36. Thus, the rotation of clamp 58*a* is resisted by a bias force F applied by the first biasing member 62*a*. As the clamp 58*a* rotates in the direction indicated by the arrow labeled R, the coiled portion 84 of the first biasing member 62*a*, which is not constrained, moves upward in the direction indicated by the arrow labeled B. Maximum compression of the first biasing member 62*a* occurs as the first leg 80 crosses an imaginary line passing through clamp pivot 78 and aperture 86. Beyond this point, the first biasing member 62*a* decompresses (i.e., first arm 80 and second arm 82 separate) towards a neutral state. Ultimately, the roller frame 34, the clamp 58, and first biasing member 62*a* move to the position shown in FIG. 6B.

Figure 7A:
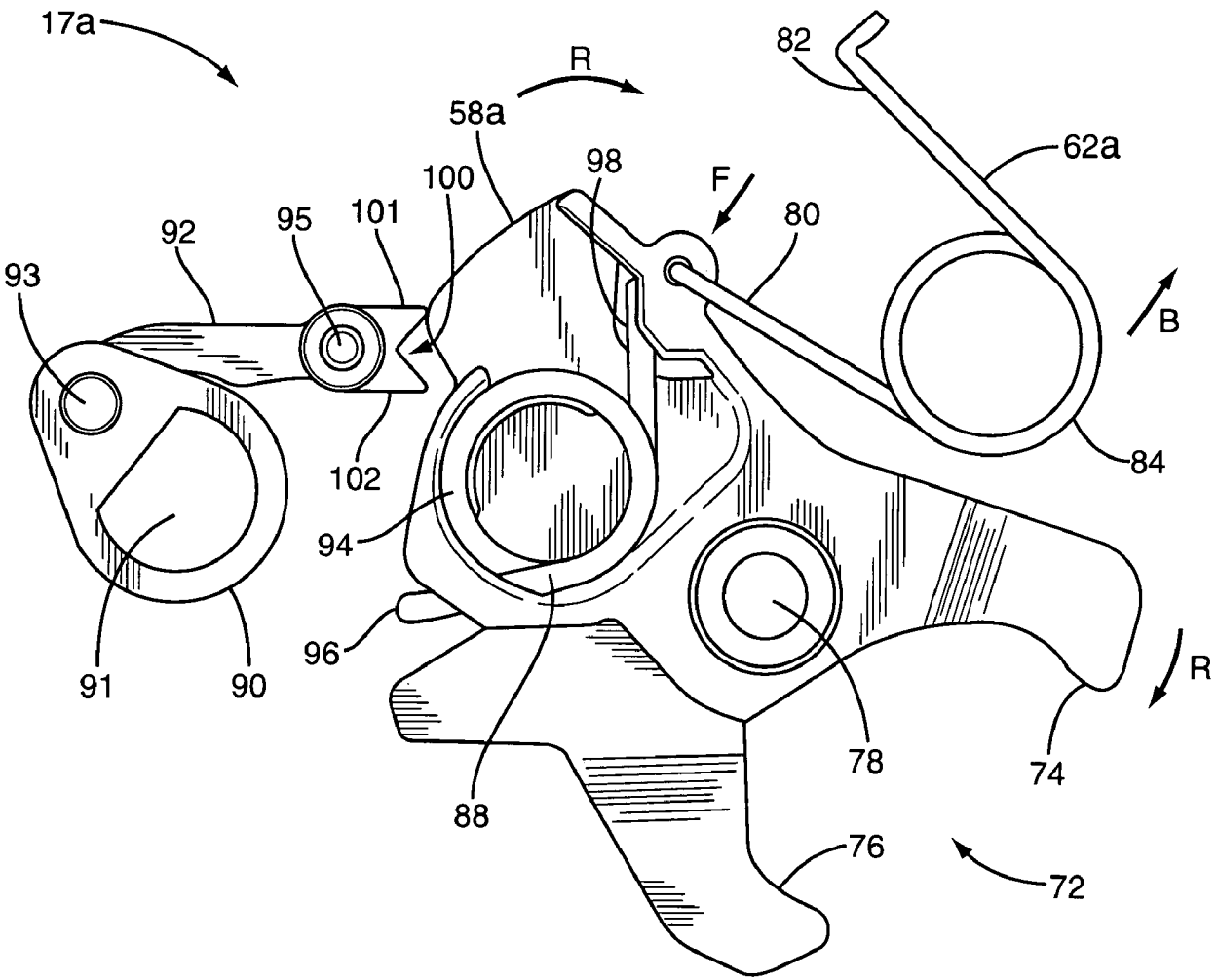
FIGS. 7A-7C are schematic diagrams showing components of a locking member according to one embodiment of the present invention in the same sequence illustrated in FIGS. 6A-6C.
Figure 7B:
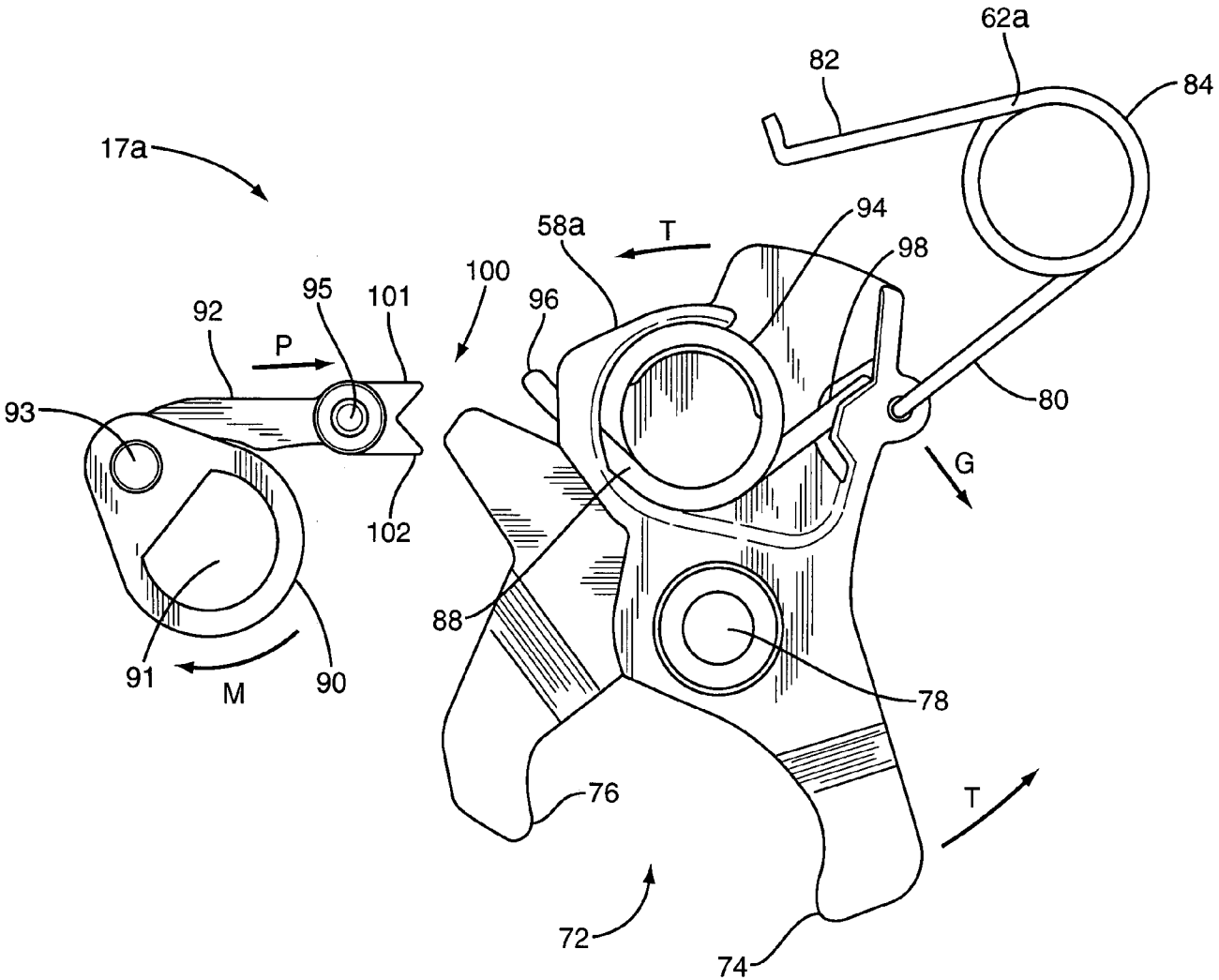
Figure 7C:
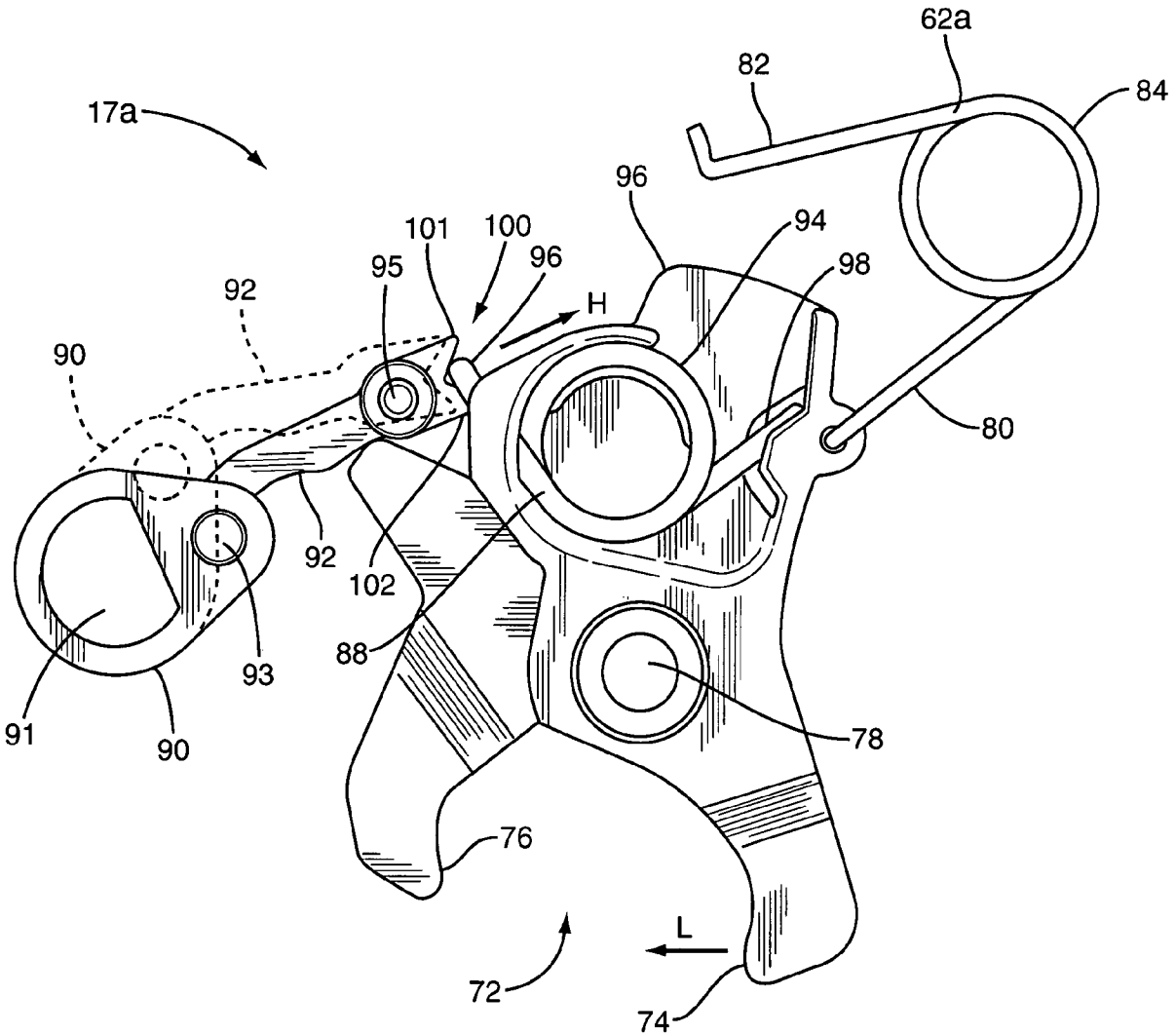
Figure 8:
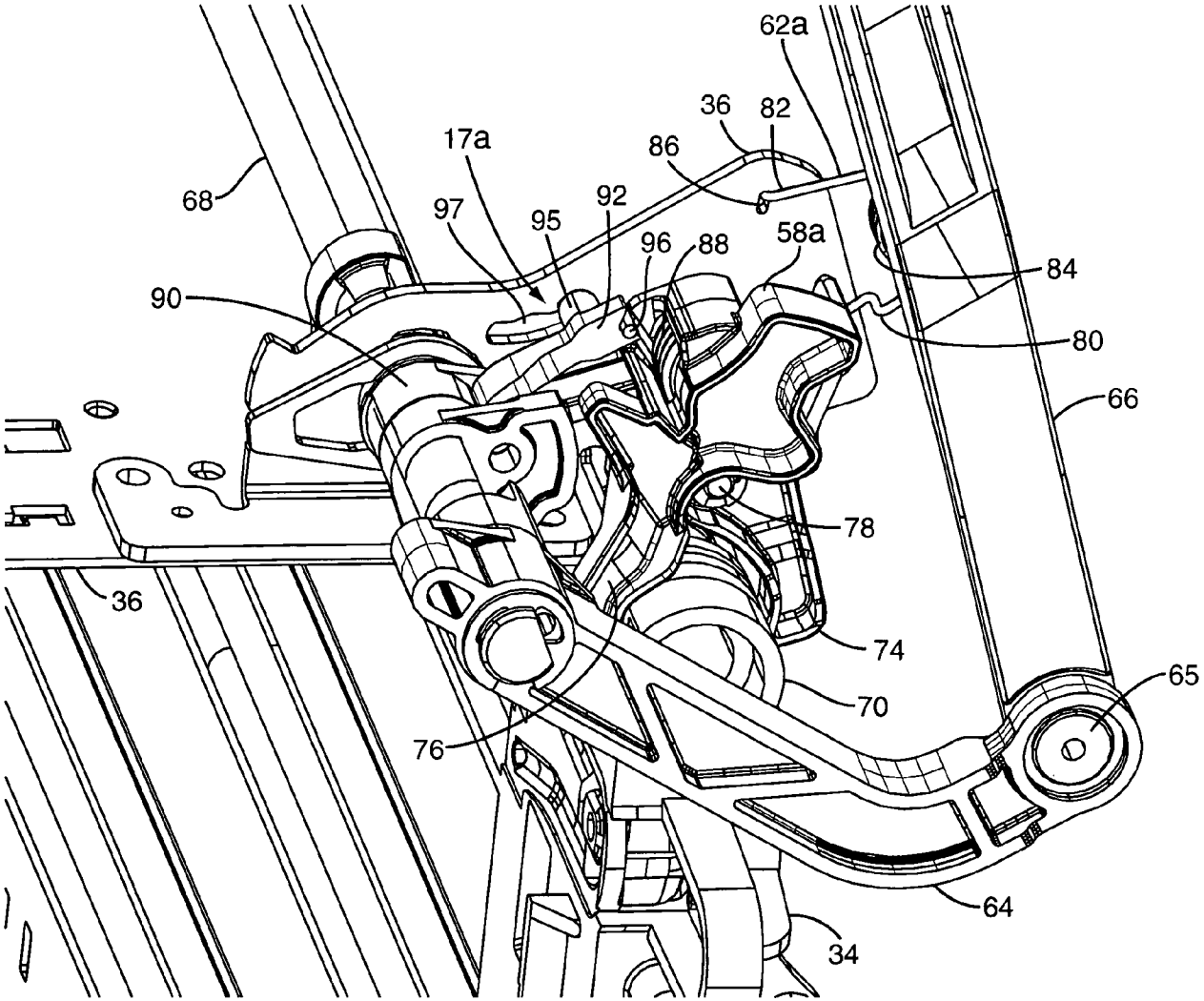
FIG. 8 is a perspective diagram showing components of a locking member securing an image forming device module according to one embodiment of the present invention.

The same relative motion between the clamp 58*a* and first biasing member 62*a* is depicted in FIGS. 7A and 7B. FIGS. 7A-7C provide a simplified representation of the upper lock 17*a* shown in the same positions as FIGS. 6A-6C. Specifically, FIGS. 7A-7C show the clamp 58*a*, first biasing member 62*a*, a second biasing member 88, a crank 90, and a link 92. The second biasing member 88, crank 90, and link 92 are actuated by opening and closing the first door assembly 11. This operation is described in greater detail below.

As with FIGS. 6A and 6B, FIGS. 7A and 7B show that the act of closing the second door assembly 13 imparts a clockwise rotation (arrow labeled R) of the clamp 58*a* and a corresponding counterclockwise rotation (arrow labeled B) of the coiled portion 84 of biasing member 62*a*. When the second door assembly 13 and roller frame 34 are in the closed position, the first biasing member 62*a* resists opening movements (arrow labeled D in FIG. 6B) and resists rotation of the clamp 58*a* (arrow labeled T in FIGS. 6B, 7B) through application of a bias force G. However, as indicated earlier, the first biasing member 62*a* may be selected to provide minimal resistance F against the closing force applied by a user in closing the second door assembly 13. Thus, the first biasing member 62*a* may not be completely effective at maintaining the roller frame 34 (and hence the photoconductive units 50 and belt module 20) in the operating position.

Accordingly, the upper and lower locks 17*a* further comprise a second biasing member to supplement the securing force G applied by the first biasing member 62*a*, 62*b*. The second biasing member 88 in the embodiment shown in FIGS. 6A-6C and 7A-7C is implemented as a torsion spring comprising a coiled portion 94, a free leg 96 and a constrained leg 98. The coiled portion 94 and the constrained leg 98 are captured within the clamp 58*a*. Thus, the second biasing member 88 rotates with the clamp 58*a* as it moves between the positions shown in FIGS. 6A, 7A and 6B, 7B. The free leg 96 extends from the clamp 58*a* and provides an engagement point to apply a second securing force to the clamp 58*a*. This second securing force is supplied by the link 92.

As indicated above, the crank 90 and link 92 are actuated as the first door assembly 11 is opened and closed. This motion is illustrated in the sequence from FIG. 6B to 6C and FIG. 7B to 7C. In FIGS. 6B and 7B, the second door assembly 13 and the roller frame 34 are in the closed orientation. At this point, when the first door assembly 11 is closed, the first pivot arm 64 and the second pivot arm 66 rotate in the directions indicated by the arrows labeled M and N in FIG. 6B, respectively. Note that the first pivot arm 64 and the second pivot arm 66 rotate relative to one another about an arm pivot 65. The crank shaft 68 has a substantially D-shaped cross section that fits within a similarly shaped aperture within the first pivot arm 64. Thus, the rotational motion imparted on the first pivot arm 64 by the second pivot arm 66 and the first door assembly 11 is transmitted to the crank shaft 68. The crank 90 shown in FIGS. 7A-7C has a similar D-shaped aperture through which the crank shaft 68 passes. Thus, the rotation of the first pivot arm 64 in the direction of arrow M is transmitted to the crank 90, which also rotates in the direction of arrow M (as illustrated in FIG. 7B).

FIGS. 7A-7C show that the link 92 is pivotally attached to the crank 90 at a crank pivot 93. Consequently, the rotary motion (in the direction indicated by the arrow labeled M) of the crank 90 produces linear motion (as indicated by the arrow labeled P) in the link 92. Furthermore, FIG. 6B shows a slot 97 that acts to constrain the motion of the link 92. The link 92 includes a protrusion 95 (not visible in FIG. 6B, but see FIGS. 7A-7C) that slides within this slot 97 to constrain the motion of the link 92 along a path defined by the slot 97.

The end of the link 92 opposite the crank pivot 93 includes two protrusions 101, 102 forming a notch 100 therebetween. This notch 100 is configured to engage the free leg 96 of the second biasing member 88 when the first door assembly 11 is moved from the open configuration to the closed configuration as depicted in FIGS. 1A, 6C, and 7C. In one embodiment, the crank 90, the link 92, the clamp 58*a*, and the interior frame 36 form a four-bar linkage that securely retains the roller frame 34 in the position shown in FIG. 6C. The solid-line representation of the crank 90 and link 92 provided in FIG. 7C represents the condition when the first door assembly 11 is completely closed and a locking force L is applied by the first clamp arm 74 on the protrusion 70. The dashed-line representation of the crank 90 and the link 92 represents the condition where the interference between the crank 90, the link 92, and the second biasing member 88 is the greatest. Thus, the solid-line representation shows an over-center position where the crank 90, the link 92, and the second biasing member 88 are locked over center.

In one embodiment, the second biasing member 88 is substantially stronger than the first biasing member 62*a* and is capable of securing the roller frame 34 in the operating position. Note however, that the leverage supplied by the relatively long pivot arms 64, 66 reduce the amount of user force required to close the first door assembly 11. The pivot arms 64, 66 are also disposed near the pivoting end of the first door assembly 11. Thus, the first door assembly 11 itself acts as a lever arm providing a mechanical advantage to move the pivot arms 64, 66 when the first door assembly 11 opens and closes.

The embodiment described above comprises multiple photoconductive units 50 and a belt module 20 that are attached to a roller frame 34. The roller frame 34 is secured by the locks 17*a*, 17*b*, which in turn, secure the photoconductive units 50 and the belt module 20 in an operating position. This embodiment is intended to provide an illustrative example of a method and apparatus for securing an image forming device module in an operating position. Therefore, it should be understood that this approach described above may be used to secure a variety of modules within an image forming device. An alternative configuration may contemplate securing a belt module 20 alone without the photoconductive units. FIG. 1C, which does not show the photoconductive units 50 attached to the roller frames 34, 35, may represent an example of this configuration.

Figure 9A:
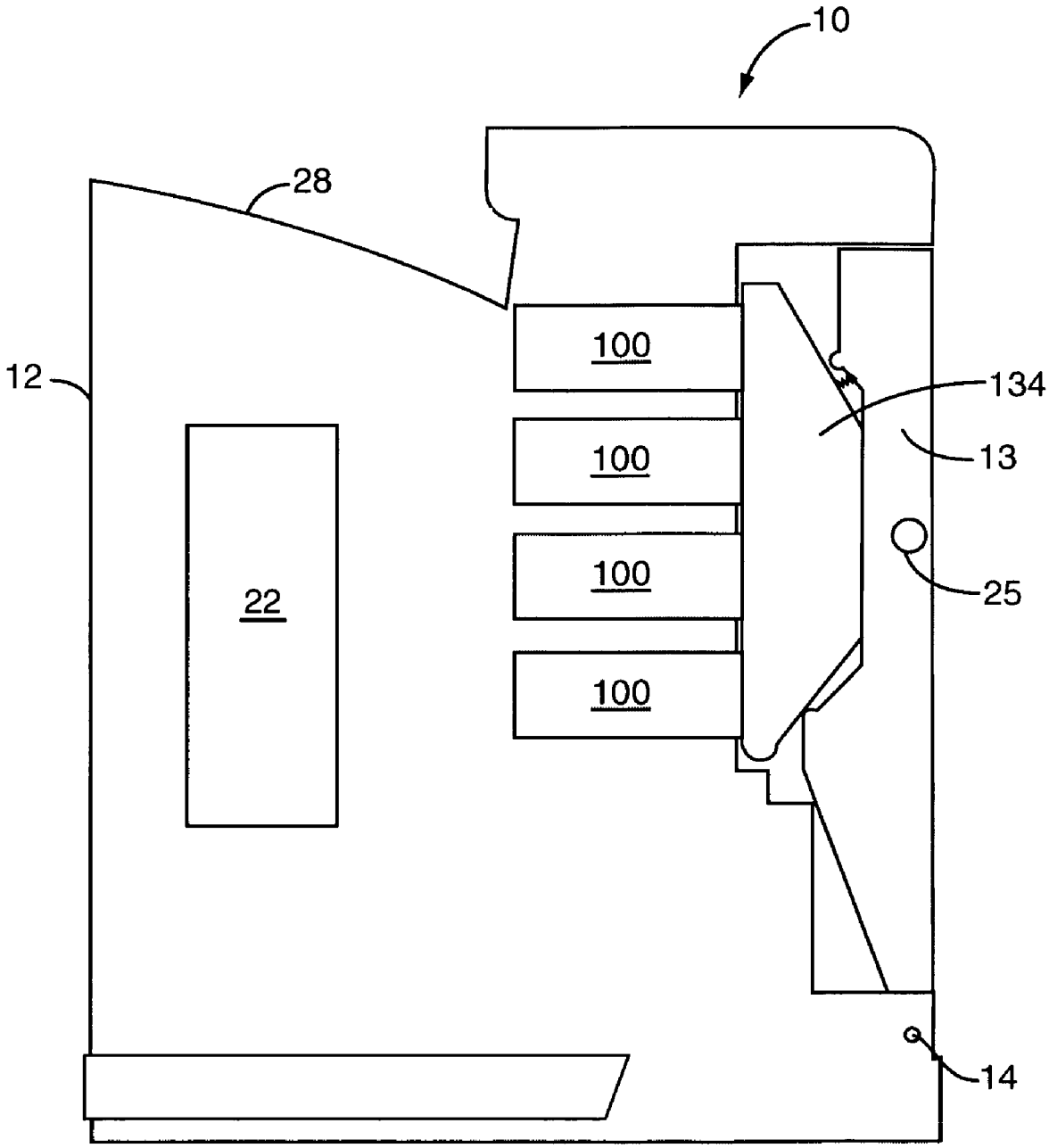
FIGS. 9A-9B are schematic diagrams showing a sequence by which a one-piece image forming unit coupled to a door assembly according to one embodiment of the present invention moves between open and closed orientations.
Figure 9B:
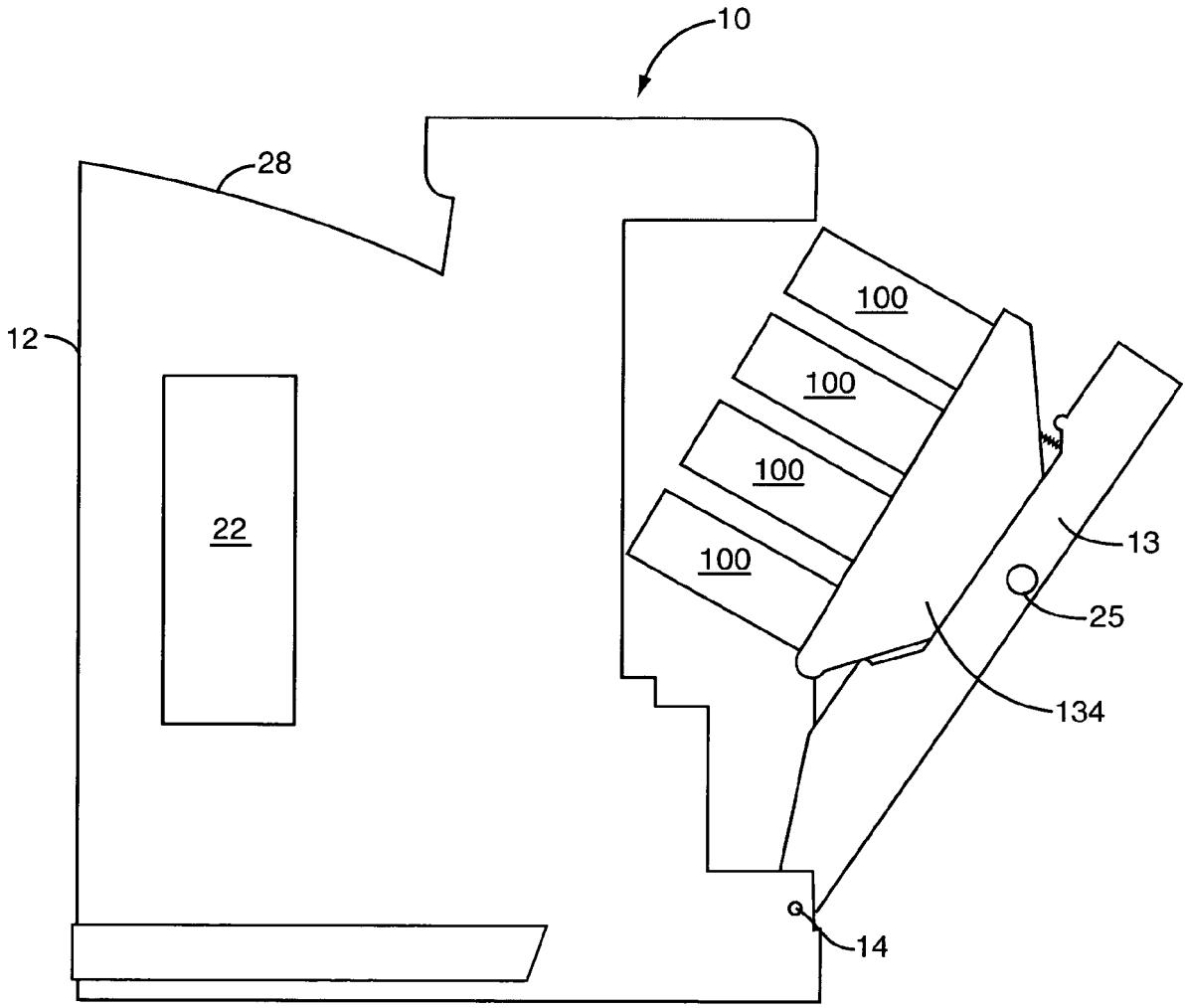

It should be understood that the roller frame 34 discussed above may be generically referred to as a frame member 134 that is coupled to a movable door assembly and to which image forming device modules are mounted. For example, the frame member 134 shown in FIGS. 9A and 9B has four image forming units 100 coupled thereto, all of which are movable with the door assembly 13. Thus, when the door assembly 13 is moved to the closed position as shown in FIG. 9A, the frame member 134 and all four image forming units 100 may be secured in the operating position using the locks 17*a*, 17*b* described above. In alternative embodiments, a variety of components may be coupled to the frame member 134, including but not limited to photoconductive members, developer members, cleaning members, transfer members, belt modules, transport members, sensors, pick mechanisms, and other components found in an image forming device 10.

Furthermore, the techniques described herein may be used to directly secure an image forming device module without the use of a separate frame member 34, 60, 134. As an example, the above described belt module 20 may be loosely coupled to the second door assembly 13 without the above described subframe 60 and secured in an operating position with the upper and lower locks 17*a*, 17*b*. Other embodiments may contemplate securing components such as photoconductive members, developer members, cleaning members, transfer members, and belt modules directly through the use of locks 17*a*, 17*b*. Further, the means by which the component is loosely coupled to the door assembly may vary. The above described embodiments included a second pivot 25 that permits relative movement between the frames 34, 134 or subframe 60 and the door assembly 13. Other embodiments may use slotted or other loose fitting attachment points to permit relative movement between the door assembly 13 and a coupled image forming unit module.

The present invention may be carried out in other specific ways than those herein set forth without departing from the scope and essential characteristics of the invention. For example, while embodiments described above have contemplated pivot arms 64, 65 that are permanently coupled to the first door assembly 11, other actuators not permanently coupled to the first door assembly 11 may be used to secure the image forming device modules in an operating position. For example, a lever arm, a slide, a knob, or other manually triggered actuator may be coupled to the crank 90 to securely retain the image forming device modules in the operating position. In other embodiments, the pivot arms 64, 65 may be uncoupled from the first door assembly 11 and implemented as lever arms that interfere with the first dour assembly 11 so that they are displaced when the door assembly 11 is opened and closed. In yet another alternative embodiment, the crank 90 may be rotated using a motor, solenoid, or other actuator that is triggered by a sensor when the first door assembly 11 is opened or closed. Further, the biasing members 62, 88 described above were implemented as torsion springs. It should be understood that other biasing members, such as coils springs or leaf springs may be used where appropriate. In addition, the locks 17*a*, 17*b* have been described as being mounted within the image forming device housing 12. Alternatively, the locks 17*a*, 17*b* may be mounted to the image forming device module that is secured by the locks 17*a*, 17*b*. The present embodiments are, therefore, to be considered in all respects as illustrative and not restrictive, and all changes coming within the meaning and equivalency range of the appended claims are intended to be embraced therein.

What is claimed is:

1. An image forming device comprising:

a body;

a first door assembly movably coupled to the body and positionable between an open orientation positioned away from the body and a closed orientation positioned in proximity to the body;

an image forming device module coupled to the first door assembly;

a first locking mechanism to secure the image forming device module to the body when the first door assembly is positioned in the closed orientation;

a second locking mechanism to secure the image forming device module to the body, the second locking mechanism engageable after the first door assembly is positioned in the closed orientation, the second locking mechanism applying a greater securing force than the first locking mechanism to secure the image forming device module to the body.

2. The image forming device of claim 1 further comprising a second door assembly movably coupled to the body and positionable between an open orientation positioned away from the body and a closed orientation positioned in proximity to the body and wherein the second locking mechanism is engaged when the second door assembly is positioned in the closed orientation.

3. The image forming device of claim 1 wherein the first locking mechanism is an over-center clamp.

4. The image forming device of claim 1 wherein the second locking mechanism is an over-center clamp.

5. The image forming device of claim 1 wherein the first locking mechanism and the second locking mechanism use a common clamp member and separate over-center biasing members to secure the image forming device module to the body.

6. The image forming device of claim 1 wherein the second locking mechanism is engageable through movement of a lever arm to rotate an over-center crank.

7. The image forming device of claim 1 wherein the image forming device module comprises a belt.

8. The image forming device of claim 1 wherein the image forming device module comprises a photoconductive member.

9. An image forming device comprising:

a body;

a first door assembly movably coupled to the body and positionable between an first open orientation positioned away from the body and a first closed orientation positioned in proximity to the body;

a second door assembly movably coupled to the body and positionable between a second open orientation positioned away from the body and a second closed orientation positioned in proximity to the body;

an image forming device module coupled to the first door assembly;

a four-bar locking mechanism to secure the image forming device module to the body with a first securing force when the first door assembly is positioned in the first closed orientation, the four-bar locking mechanism applying a second securing force that is greater than the first securing force when the second door assembly is positioned in the second closed orientation.

10. The image forming device of claim 9 wherein the four-bar locking mechanism comprises a first biasing member that applies the first securing force when the first door assembly is positioned in the first closed orientation.

11. The image forming device of claim 10 wherein the four-bar locking mechanism comprises a second biasing member that applies the second securing force when the second door assembly is positioned in the second closed orientation.

12. The image forming device of claim 11 wherein the four-bar locking mechanism comprises a moveable link that moves in conjunction with the second door assembly, the moveable link engaging the second biasing member to apply the second securing force when the second door assembly is positioned in the second closed orientation.

13. The image forming device of claim 9 wherein the four-bar locking mechanism comprises a pivot arm that is pivotally attached to the second door assembly and an over-center crank that is rotated by the pivot arm when the second door assembly is moved between the second open orientation and the second closed orientation.

14. The image forming device of claim 9 wherein the image forming device module comprises a belt.

15. The image forming device of claim 9 wherein the image forming device module comprises a photoconductive member.

16. A method of securing an image forming device module in an operating position within an image forming device, the method comprising:

coupling said image forming device module to a first door assembly;

moving the first door assembly from a first open orientation to a first closed orientation, thereby securing said image forming device module with a first retaining force;

moving a second door assembly from a second open orientation to a second closed orientation, thereby securing said image forming device module with a second retaining force that is greater than the first retaining force.

17. The method of claim 16 wherein securing said image forming device module with a first retaining force comprises engaging an over-center clamp having a first biasing member to apply the first retaining force.

18. The method of claim 17 wherein securing said image forming device module with a second retaining force comprises engaging an over-center clamp having a second biasing member to apply the second retaining force.

19. The method of claim 16 wherein securing said image forming device module with a first retaining force and securing said image forming device module with a second retaining force comprises biasing a common over-center clamp with a first biasing member to apply the first retaining force and with a second biasing member to apply the second retaining force.

20. The method of claim 16 wherein securing said image forming device module with a second retaining force comprises rotating an over-center crank by displacing a lever arm when moving the second door assembly from the second open orientation to the second closed orientation.

21. The method of claim 20 further comprising pivotally coupling the lever arm to the second door assembly.

* * * * *